US007758054B2

(12) United States Patent
Abel et al.

(10) Patent No.: US 7,758,054 B2
(45) Date of Patent: Jul. 20, 2010

(54) ROLLER SKATE

(75) Inventors: Helmut Abel, 11 bis, av. Edouard VII, Maisons-Laffitte, F-78600 (FR); Olivia Dehaeseleer, Maisons-Laffitte (FR); Céline Abel, Maisons-Laffitte (FR); Diane Abel, Maisons-Laffitte (FR)

(73) Assignee: Helmut Abel, Maisons-Laffitte (FR)

( * ) Notice: Subject to any disclaimer, the term of this patent is extended or adjusted under 35 U.S.C. 154(b) by 36 days.

(21) Appl. No.: 12/067,589

(22) PCT Filed: Nov. 17, 2006

(86) PCT No.: PCT/EP2006/011059

§ 371 (c)(1),
(2), (4) Date: Mar. 20, 2008

(87) PCT Pub. No.: WO2007/065553

PCT Pub. Date: Jun. 14, 2007

(65) Prior Publication Data

US 2008/0185798 A1 Aug. 7, 2008

(30) Foreign Application Priority Data

Dec. 8, 2005 (DE) ..... 10 2005 059 069

(51) Int. Cl.
*A63C 17/02* (2006.01)

(52) U.S. Cl. ..... 280/11.222; 280/11.232; 280/11.27

(58) Field of Classification Search ..... 280/11.222, 280/11.232, 11.221, 11.231, 11.27
See application file for complete search history.

(56) References Cited

U.S. PATENT DOCUMENTS

| | | | | | |
|---|---|---|---|---|---|
| 208,235 | A * | 9/1878 | Gregg | 280/11.19 |
| 233,845 | A * | 11/1880 | Gregg | 280/11.19 |
| 1,017,162 | A * | 2/1912 | Naumann | 280/11.25 |
| 1,379,250 | A * | 5/1921 | Clark | 280/11.215 |
| 2,430,037 | A * | 11/1947 | Vincent | 280/11.209 |
| 4,394,028 | A * | 7/1983 | Wheelwright | 280/11.19 |
| 5,183,276 | A * | 2/1993 | Pratt | 280/11.221 |
| 5,224,718 | A * | 7/1993 | Gertler | 280/11.19 |
| 5,251,920 | A * | 10/1993 | McHale | 280/11.19 |
| 5,303,940 | A * | 4/1994 | Brandner | 280/11.223 |
| 5,312,120 | A * | 5/1994 | Wiegner | 280/11.212 |
| 5,551,713 | A | 9/1996 | Alexander | |
| 5,908,196 | A * | 6/1999 | Weiss | 280/11.19 |
| 5,951,028 | A * | 9/1999 | Lovitt et al. | 280/11.222 |
| 6,070,885 | A * | 6/2000 | Ferone | 280/11.19 |
| 6,273,437 | B1 * | 8/2001 | Lovitt et al. | 280/11.233 |

(Continued)

FOREIGN PATENT DOCUMENTS

DE 29620280 U 1/1997

(Continued)

*Primary Examiner*—Jeffrey J Restifo
(74) *Attorney, Agent, or Firm*—Peter A. Chiabotti; Akerman Senterfitt

(57) ABSTRACT

The roller skate according to the invention is equipped with smaller inline rollers (40) arranged below the boot (10) and with outer, larger rollers (30), the upper parts of which protrude above the boot sole (11). This roller skate can be moved on four rollers (30) and (40) in the manner of a four-wheel roller skate, or, in certain phases, just on two inline rollers (40) in a similar manner to an inline skate.

5 Claims, 5 Drawing Sheets

U.S. PATENT DOCUMENTS

| | | | | |
|---|---|---|---|---|
| 6,398,229 | B1 * | 6/2002 | Saylor | 280/11.19 |
| 6,422,578 | B1 * | 7/2002 | Oh | 280/11.232 |
| 6,443,464 | B2 | 9/2002 | Lovitt et al. | |
| 6,467,777 | B2 * | 10/2002 | Teyhen | 280/11.115 |
| 6,698,776 | B2 * | 3/2004 | Todd | 280/87.042 |
| 6,722,670 | B1 | 4/2004 | Lee | |
| 6,874,795 | B2 * | 4/2005 | Sung | 280/11.223 |
| 7,175,187 | B2 * | 2/2007 | Lyden | 280/11.3 |
| 7,523,948 | B1 * | 4/2009 | Wright | 280/11.222 |
| 2002/0125658 | A1 | 9/2002 | Alwarid | |
| 2003/0057665 | A1 | 3/2003 | Matney | |
| 2008/0185798 | A1 * | 8/2008 | Abel et al. | 280/11.19 |
| 2009/0079147 | A1 * | 3/2009 | Conners et al. | 280/11.223 |

FOREIGN PATENT DOCUMENTS

| | | |
|---|---|---|
| DE | 29920398 U | 3/2000 |
| WO | 99/04871 | 2/1999 |
| WO | 02/068070 | 9/2002 |
| WO | WO 02068070 | 9/2002 |
| WO | 2004/110574 | 12/2004 |

* cited by examiner

ROLLER SKATE

CROSS REFERENCE TO RELATED APPLICATION

This application is a §371 National Phase of PCT/EP2006/011059, filed Nov. 17, 2006, the entirety of which is hereby incorporated by reference.

BACKGROUND OF THE INVENTION

The invention relates to a roller skate.

Roller skates with four rollers arranged in pairs as well as with several rollers arranged in series, so-called inliners, and with mixed forms are known.

The best-known ones are the four-wheel roller skates, that are generally equipped with four often relatively wide, usually cylindrical rollers with the same diameter. During travel such roller skates are placed on the road surface as a rule as horizontally as possible with all four rollers at the same time.

The shoes of these four-wheel roller skates, that comprise front and back rollers that can be guided to a limited extent, are relatively low in the heel area so that the user can bend his legs to both sides in the area above the ankle. This makes it possible, by virtue of the oblique position of his legs, to control the front and back rollers of four-wheel roller skates, which rollers can be guided to a limited extent. However, an oblique position of the roller skates is not possible or not readily possible.

U.S. Pat. No. 5,551,713 teaches a roller skate in which only the two back rollers are adjacent to one another as in the four-wheel roller skates but the two front rollers are arranged centrally and in series as in inliners. The back rollers are located far apart from one another and on the outside of the shoe and can be guided in a limited manner. Even this roller skate must be placed as horizontally as possible on the road surface during travel, that is, not in an oblique position as in the case of customary inliners. The guiding of the two rear rollers is difficult on account of the front rollers that are arranged in series but are inflexible so that a correct curve travel is hardly possible.

The guiding of the three-wheel roller skate, the so-called Dutch skate, that was put on the market in the 50s, is somewhat simpler. This skate has a large roller in front of the shoe and two equally large rollers that are, however, arranged on the sides of the shoe and extend upward above the shoe sole. However, even this shoe should be placed as horizontally as possible, that is, not in an oblique position, on the road surface.

U.S. Pat. No. 6,722,670 teaches a roller skate with a different shape that comprises three rollers arranged adjacent to each other on a front wheel axle and three on a back wheel axle, namely, a central, approximately cylindrical roller and two conically designed rollers located on the outside in each instance. These conical rollers should make an oblique position possible up to a certain inclination and prevent lateral slipping. However, during normal travel, e.g., over straight stretches, only the two central cylindrical rollers make contact with the ground whereas the outer, conical rollers, whose diameter is smaller than the diameter of the central rollers, do not touch the road surface. The roller skate rests on the road surface with four rollers only at a certain angle of inclination and curve travel is hardly possible. On the other hand, at a lesser angle of inclination this roller skate behaves like the known inliners.

The inliners that are very common today are equipped with rollers that are arranged centrally under the shoe sole and vertically in series.

Recently, a two-wheel inliner with overlarge, obliquely projecting rollers has come on the market that is like the one known from U.S. Pat. No. 5,951,028; U.S. Pat. No. 6,273,437 B1 and U.S. Pat. No. 6,443,464 B2. The oblique position of the rollers permits extreme oblique positions of the user as well as the use of larger rollers, given a good contact with the ground, since the latter can project laterally over the boot of the roller skate.

However, it is characteristic for all inliners that their serial rollers have exclusively a linear contact so that the travel with these inliners requires a not inconsiderable degree of skill, force and a good feeling of equilibrium.

This, it can be determined that, although in the meantime many millions of these inliners have been sold in past years to sportspersons of all age groups, a large part of these inliners are not being used or are no longer in use, probably on account of these problems.

It is difficult for a beginner to keep his balance on these inliners since he must constantly compensate transverse movements. This unaccustomed strain stresses the untrained feet, ankles, feet muscles and sinews of the user to a great extent.

Thus, it turned out that a satisfactory usage of these inliners is only possible for those persons who are well-trained and on the other hand have a good technical understanding or feeling for the progression of movement with inliners.

SUMMARY OF THE INVENTION

The present invention has the basic problem of designing these known inliners in such a manner that the physical strain on the users is reduced and that better comfort during travel and in particular considerably more travel safety is offered so that these roller skates are better suited even for less experienced and less talented users.

The invention starts from a roller skate with a boot basically known from WO 02/068070 A1 on the sole of which a frame with two or more inline rollers serially arranged under the boot in the direction of travel is provided as well as with at least one laterally offset roller. This third roller, that is connected on the inside of the shoe in an articulated manner via a spring arm in an elastic manner to the frame should make brief contact with the traveling surface only when pushing off, that is, when the foot comes into the oblique position of pushing off.

However, such a roller skate design of the type discussed in the background section is not suited for avoiding the above-describe disadvantages and solving the basic problem of the invention.

This problem is solved in accordance with the present invention with a roller skate as discussed herein.

Instead of a laterally offset third roller adjacent to the inline rollers, outer rollers are arranged in the area of the outside of the shoe that extend upward over the sole of the boot and whose diameter is greater than the diameter of the inline rollers. The inline rollers are mounted on the frame in such a manner that their bearing surface is at a distance from the traveling surface in the case of a sole situated parallel to the traveling surface. When standing and during travel these outer rollers serve as support, which avoids the very unpleasant and strenuous lateral tilting movements whereas during pushing off exclusively the inline rollers make contact with the traveling surface.

The fact that the diameter of the outer rollers is greater than the diameter of the inline rollers facilitates traveling over hindrances in the road surface. In one embodiment, the axles of the outside rollers are located in the direction of travel in front of the axles of the inline rollers.

Other structures and their structural arrangements result in an improvement of the travel comfort.

If the roller skate is equipped with very narrow outer rollers at a great distance from its support in the hub, the construction in which the inner ball bearing is arranged in an inwardly projecting hub ring can be helpful.

It proved to be advantageous if the longitudinal axis of the inline rollers running in the direction of travel is inwardly offset relative to the parallel, central longitudinal axis of the boot sole. In this roller arrangement it is relatively simple for the users to go out of the four-roller position into the inline roller position.

DESCRIPTION OF THE DRAWINGS

The invention is described in detail in the following using a preferred exemplary embodiment shown in the drawings.

DETAILED DESCRIPTION OF THE PREFERRED EMBODIMENTS

Figure 1:
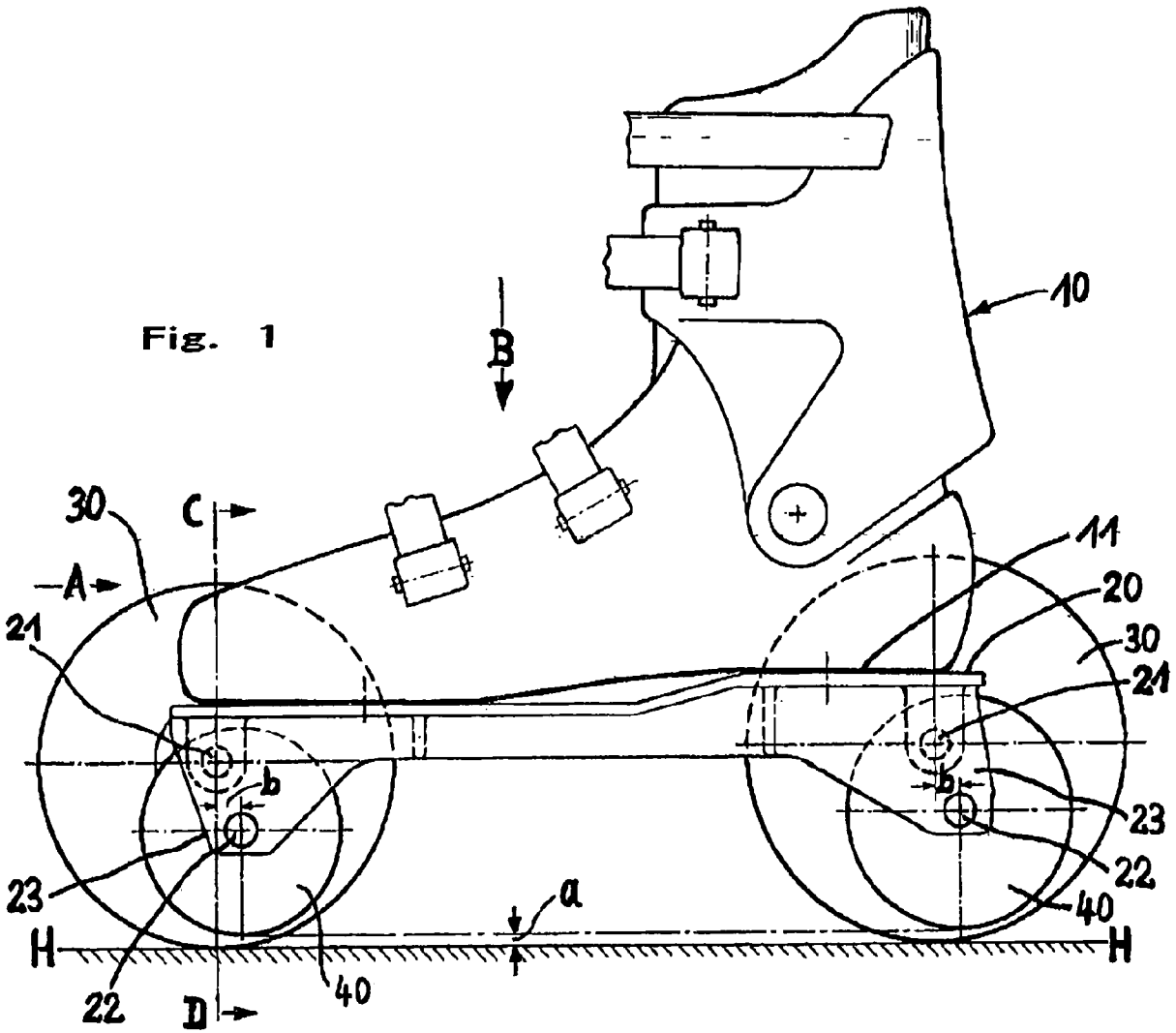
FIG. 1 shows a lateral view of the right roller skate in accordance with the invention.

The invention is explained using the right roller skate of a pair of roller skates that is shown in different positions in FIGS. 1 to 5.

The roller skate consists substantially of a boot 10 on whose boot sole 11 the frame 20 with rollers 30 and 40 and serving as roller carrier element is fastened. The left roller skate (not shown) is constructed homologously. The larger rollers 30 are vertical to traveling surface H-H in this view. They are always located on the outside of the roller skate. The smaller rollers 40, that are located under boot 10 in a manner similar to inliners and therefore are designated in the following as inline rollers, maintain a distance a from the surface of traveling surface H-H.

Figure 2:
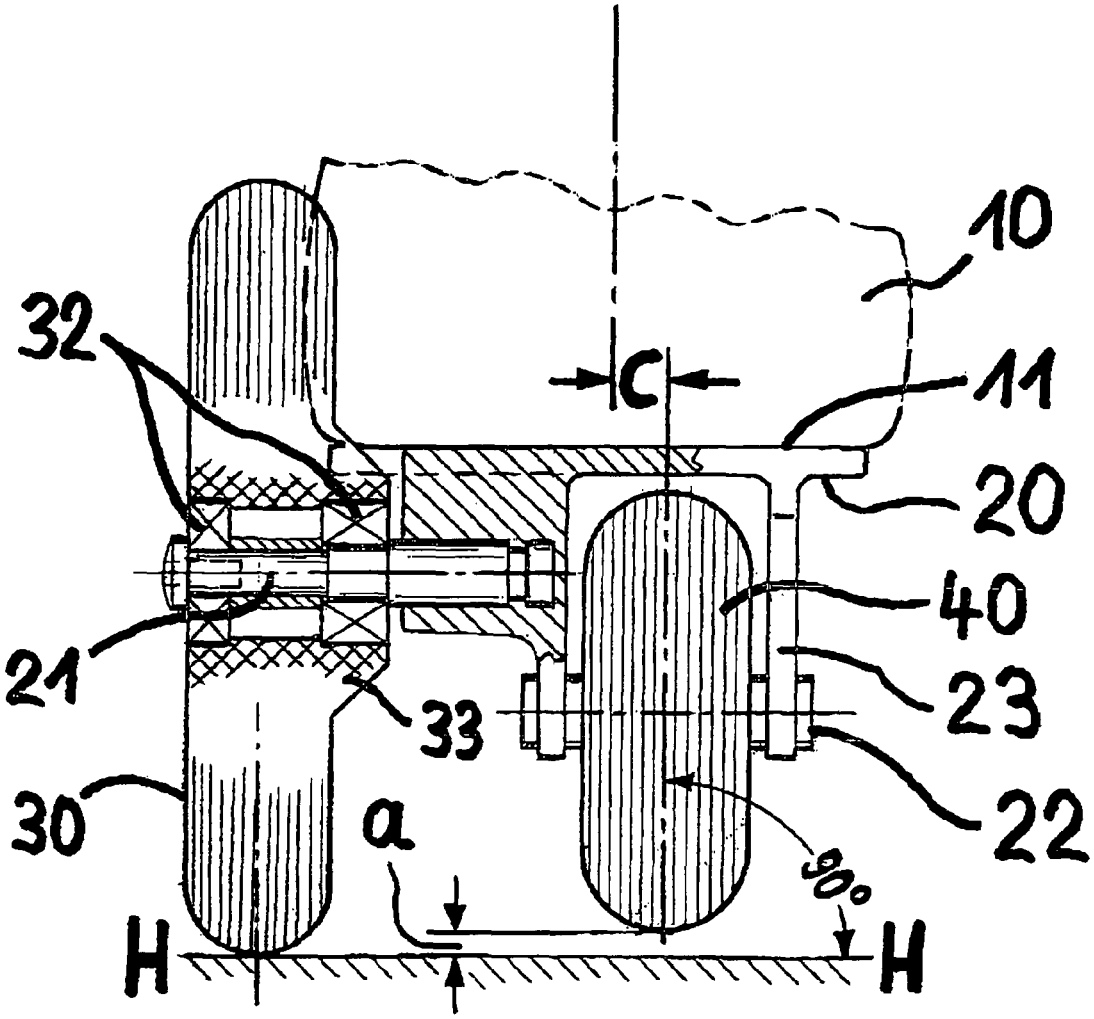
FIG. 2 shows a detailed view of the roller skate according to FIG. 1 viewed in direction A and in partial section.
Figure 3:
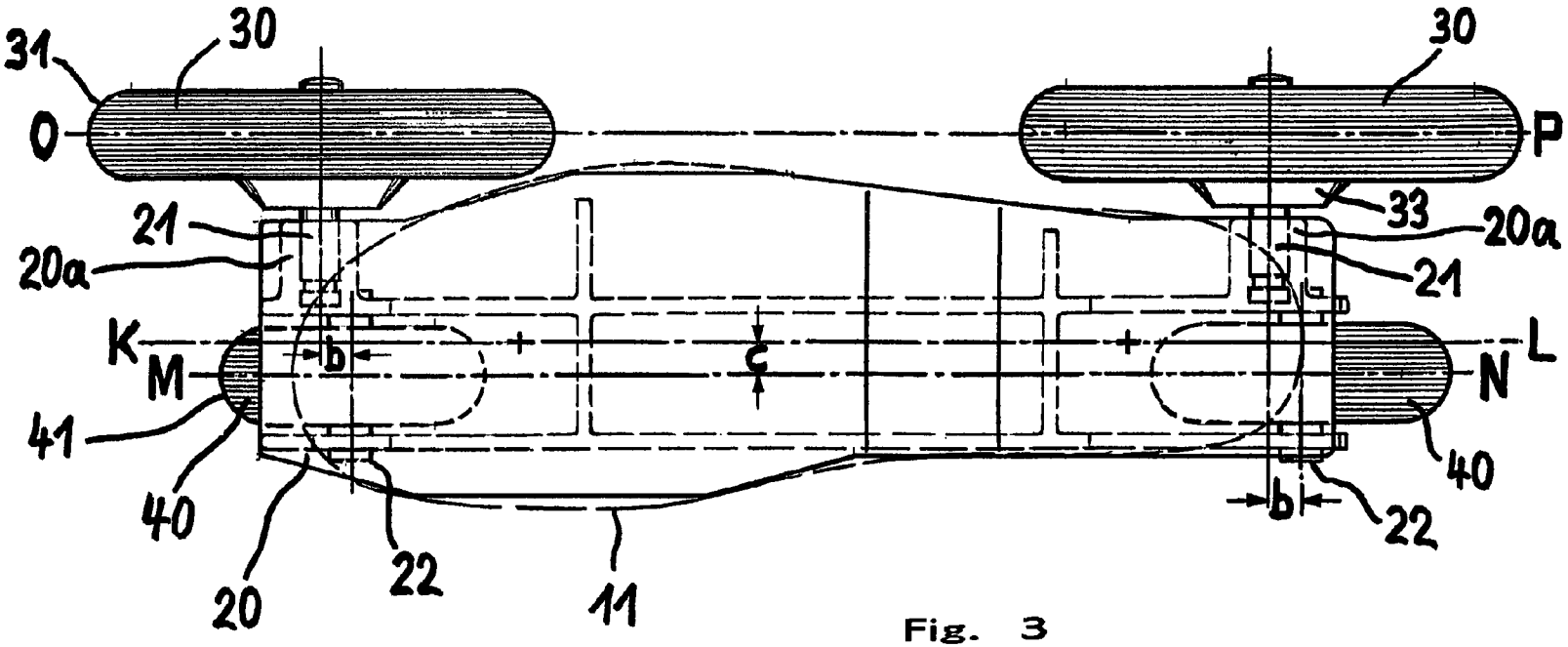
FIG. 3 shows a top view of the roller skate according to FIG. 1 viewed in direction B, in which only the sole of the shoe is shown.

In the exemplary embodiment shown in FIGS. 1 to 3 the back outer roller 30 is larger and wider that the front one.

The frame 20 consisting of injection-molding aluminum, injection-molding plastic or of welded steel comprises wheel forks 23 on its bottom that carry roller axles 22 for inline rollers 40. As FIG. 1 shows, inline roller axles 22 are offset by amount b in the direction of travel relative to axles 21 for outer rollers 30. This offset and the dimensioning of rollers 30 and 40 facilitate traveling over rugosities of the ground on traveling surface H-H.

Outer rollers 30 equipped with ball bearings 32 are supported on axles 21 set in an axle receptacle 20*a* of frame 20 and projecting laterally. Roller 30 is equipped in the area of inner ball bearing 32 with an inwardly projecting hub ring 33 for reinforcement.

As the view in FIG. 3 shows, outer rollers 30 are located on a line O-P running parallel to longitudinal axis K-L of the boot. Inline rollers 40 are located on the line M-N running parallel to longitudinal axis K-L of the boot, which line M-N is offset laterally by distance c relative to axis K-L.

The following dimensions have proven to be advantageous:

| | |
|---|---|
| Diameter of the back outer roller 30: | 150 mm |
| Diameter of the front outer roller 30: | 140 mm |
| Diameter of the back inline roller 40: | 90 mm |
| Diameter of the front inline roller 40: | 80 mm |
| Distance from ground a: | 4 mm |
| Axial offset b: | 10 mm |
| Distance of longitudinal axis M-N c: of the inline rollers from longitudinal axis K-L of the boot sole: | = 10 mm. |

Bearing surfaces 31 of outer rollers 30 and bearing surfaces 41 of inline rollers 40 are preferably spherically designed.

Figure 4:
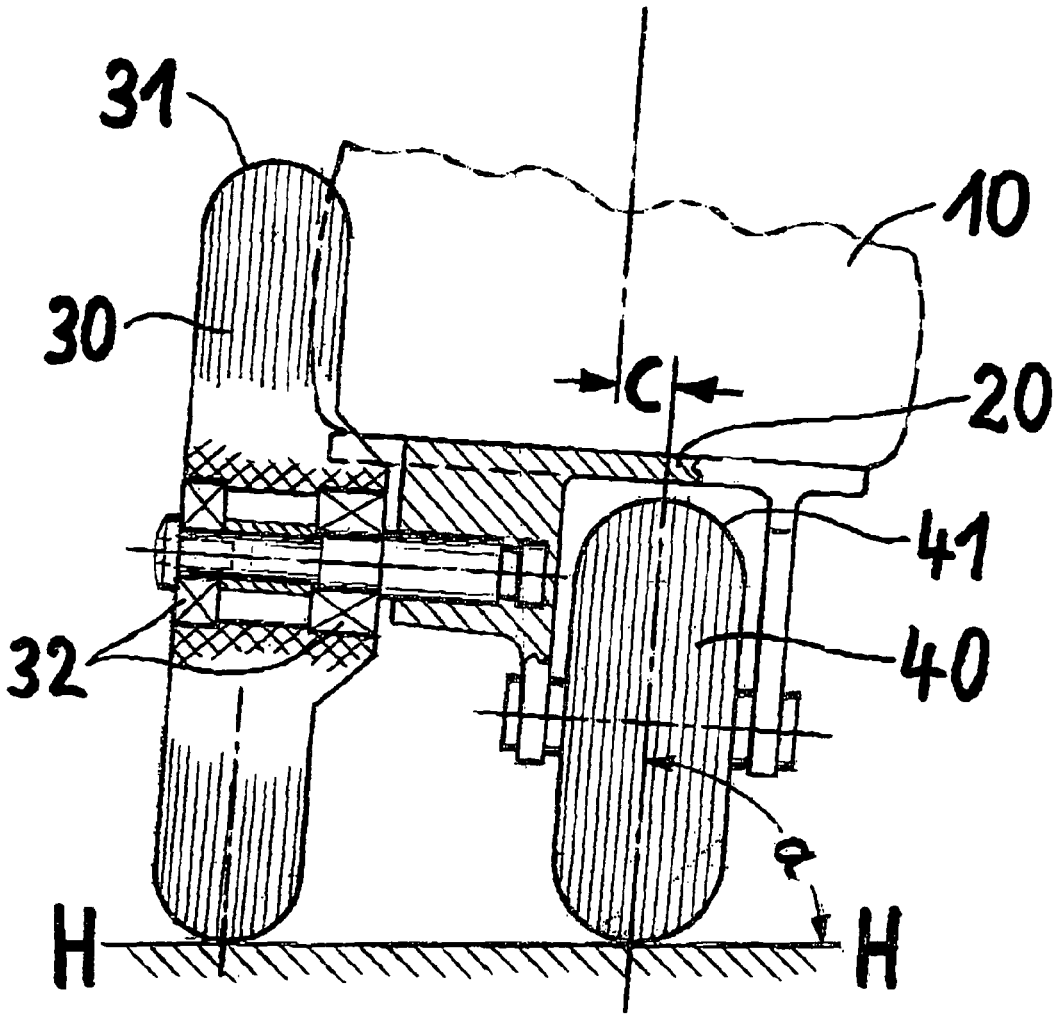
FIG. 4 shows a front view according to FIG. 2 but in a slightly inclined position.

The dimensioning explained above permits a positioning of the roller skate for comfortable standing and traveling, as is illustrated with FIG. 4. In this position the roller skate is inclined by approximately 3 to 4° relative to traveling surface H-H so that inline roller 40 assumes an angle $\alpha$=86° to 87° relative to traveling surface H-H. This position is comfortable and less strenuous when standing and traveling, especially for untrained beginners, and imparts a feeling of security since all four rollers make contact with the ground. Since the feet of the user are supported by these four rollers they do not become tired even when sloppily buckled in boot 10.

A beginner will at first carefully start to travel from this position like with a known four-wheel roller skate.

Figure 5:
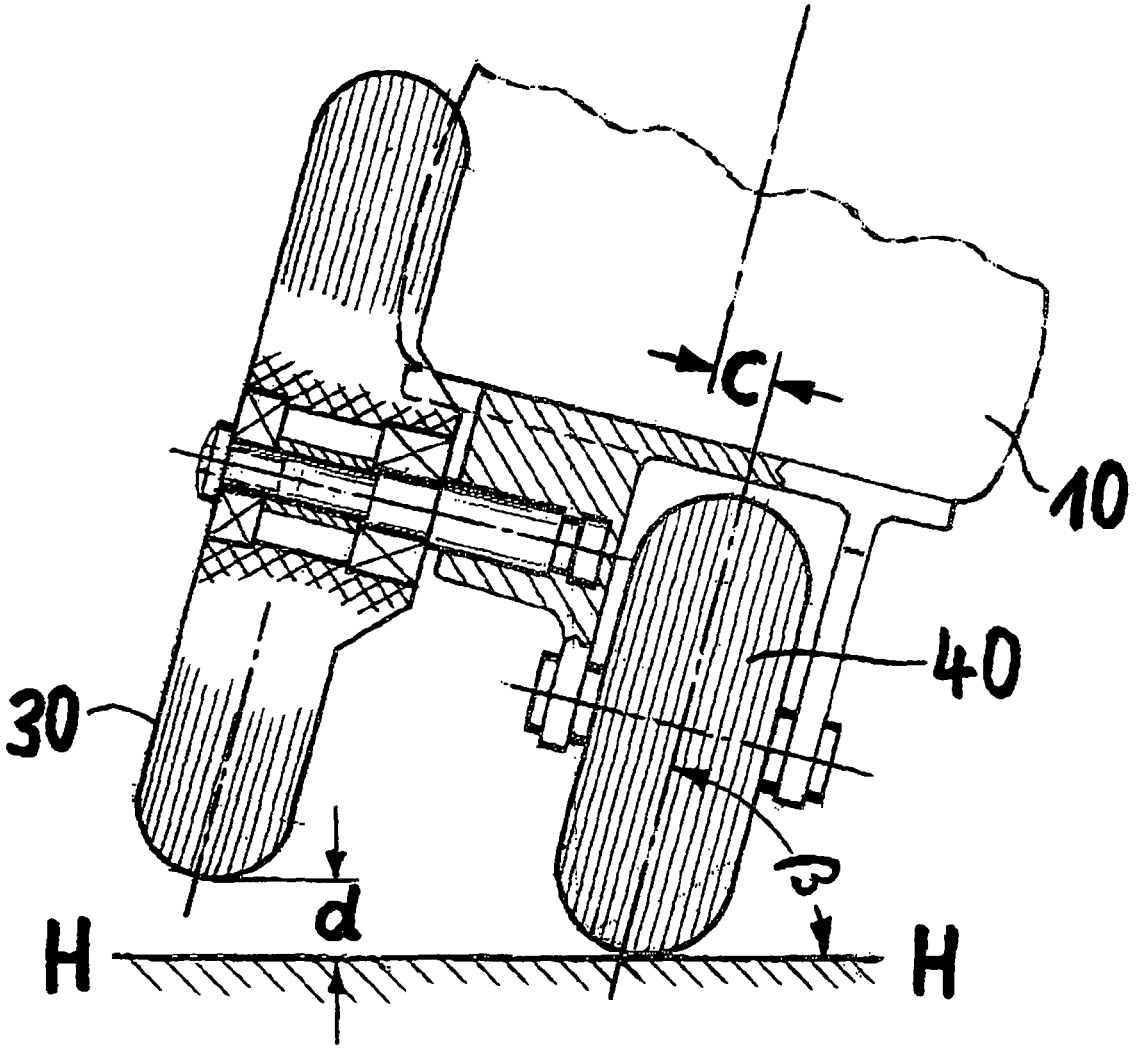
FIG. 5 shows a front view according to FIG. 4 in a more strongly inclined position.

After some practice he will move out of the position shown in FIG. 4 into the position shown in FIG. 5 in which the roller skate briefly travels like an inliner on inline rollers 40, especially when pushing off and accelerating. In this instance outer rollers 30 lift off from traveling surface H-H by distance d and the inclination of rollers 40 is reduced to a smaller angle $\beta$.

After this pushing-off and accelerating phase the roller skate of the invention can be traveled on all four rollers 30 and 40 like a conventional four-wheel roller skate, which significantly removes the load from the user's feet.

The transition from the position shown in FIG. 4 into the position according to FIG. 5 takes place in a simple manner and without great expenditure of force, which is favored by the initial inclination $\alpha$, the dimensioning of the rollers and by the only slight offset C of inline rollers 40 relative to longitudinal axis K-L of the boot soles.

The dimensioning and positioning of outer rollers 30 facilitates, as already mentioned above, the traveling over hindrances such as, gear transverse grooves or transversely located ground swells in the traveling surface. Thus, in such instances the front roller will travel over the hindrance at first, during which frame 20 is raised, so that the smaller front inline roller 40 does not make contact with the traveling surface or only brushes it. The same applies to traveling over the hindrance with the back rollers.

The roller skate in accordance with the invention thus offers more security while traveling, traveling comfort and traveling enjoyment than the known roller skates and inliners.

In addition, the roller skate requires less expenditure of force on account of the better distribution of the body weight onto the four rollers and on account of the stable support of the four rollers on the ground when traveling or in standing or resting phases.

Therefore, this roller skate is better suited for beginners as well as for sportsmen with less experience than the traditional inliners are.

| List of reference numerals | |
|---|---|
| 10 | boot |
| 11 | boot sole |
| 20 | frame (roller carrier element) |
| 20a | axle receptacle |
| 21 | roller axle for outer roller |
| 22 | roller axle for inline roller |
| 23 | wheel fork |
| 30 | outer roller |
| 31 | bearing surface |
| 32 | ball bearing |
| 33 | hub ring |
| 40 | inline roller |
| 41 | bearing surface |
| a | distance |
| b | offset |
| c | distance |
| d | distance from ground |
| α | angle of inclination |
| β | angle of inclination |
| A | direction of front view |
| B | direction of top view |
| C-D | section shown in FIG. 2 |
| H-H | traveling surface |
| K-L | longitudinal axis of the boot soles |
| M-N | longitudinal axis for inline rollers |
| O-P | longitudinal axis for outer rollers. |

The invention claimed is:

1. A roller skate, comprising:

a boot on whose sole a frame is provided with two or more inline rollers arranged in a linear series in a direction of travel underneath the boot;

wherein, adjacent to the inline rollers, a linear series of outer rollers are arranged in an area of an outside of the shoe that extend upward over the sole of the boot and whose diameter is greater than a diameter of the inline rollers, and that the inline rollers are mounted on the frame in such a manner that their bearing surfaces are at a distance from a traveling surface when a sole is situated parallel to the traveling surface;

wherein a longitudinal axis of the inline rollers running in the direction of travel is offset inwardly relative to a parallel, central longitudinal axis of the boot soles and; wherein axles of the outer rollers are located in the direction of travel in front of the axles of the inline rollers.

2. The roller skate according to claim 1, wherein the outer rollers include a front outer roller and a back outer roller, the front outer roller has a smaller diameter than the back outer roller.

3. The roller skate according to one of claim 2, wherein the back outer roller is wider than the front outer roller.

4. The roller skate according to claim 1, wherein the bearing surfaces of the outer rollers and the inline rollers are spherical.

5. The roller skate according to claim 1, wherein the outer rollers are supported by ball bearings on laterally projecting roller axles attached to the frame and comprise inwardly projecting hub rings in which the ball bearings is arranged.

* * * * *